US011971232B1

(12) United States Patent
Woodard

(10) Patent No.: US 11,971,232 B1
(45) Date of Patent: Apr. 30, 2024

(54) FIREARM LOCKING SYSTEM

(71) Applicant: Claude L. Woodard, Omaha, NE (US)

(72) Inventor: Claude L. Woodard, Omaha, NE (US)

( * ) Notice: Subject to any disclaimer, the term of this patent is extended or adjusted under 35 U.S.C. 154(b) by 0 days.

(21) Appl. No.: 18/423,909

(22) Filed: Jan. 26, 2024

Related U.S. Application Data

(63) Continuation-in-part of application No. 18/510,225, filed on Nov. 15, 2023, now Pat. No. 11,906,258.

(51) Int. Cl.
*F41A 17/44* (2006.01)

(52) U.S. Cl.
CPC ..... *F41A 17/44* (2013.01)

(58) Field of Classification Search
CPC ..... F41A 17/34; F41A 17/36; F41A 17/38; F41A 17/44
See application file for complete search history.

(56) References Cited

U.S. PATENT DOCUMENTS 4,528,765 A * 7/1985 Johnson ..... F41A 17/44 42/70.11
4,619,062 A * 10/1986 Johnson ..... F41A 17/44 42/70.11
4,709,496 A * 12/1987 Johnson ..... F41A 17/44 42/70.11
6,052,934 A * 4/2000 Carpenter ..... F41A 17/44 42/70.11
6,256,919 B1 * 7/2001 Brazeau ..... F41A 17/44 42/70.11
6,256,920 B1 * 7/2001 Olson ..... F41A 17/44 42/70.11
6,308,450 B1 * 10/2001 Ireblad ..... F41A 17/44 42/70.11
7,891,129 B2 * 2/2011 Parry, Jr. ..... F41A 35/02 42/96
10,422,601 B2 * 9/2019 Harris ..... F41A 9/65
10,488,142 B2 * 11/2019 Jacobson ..... F41A 23/18
11,802,746 B2 * 10/2023 Palovaara ..... F41A 17/44
2015/0290775 A1 * 10/2015 Bennett ..... B25B 11/00 269/287
2018/0023911 A1 * 1/2018 Harris ..... F41A 17/44 42/70.02
2018/0238650 A1 * 8/2018 Stockton ..... F41A 17/44
2022/0268544 A1 * 8/2022 Palovaara ..... F41A 23/18

* cited by examiner

*Primary Examiner* — Joshua E Freeman
(74) *Attorney, Agent, or Firm* — Nasr Patent Law LLC; Faisal K. Abou-Nasr

(57) ABSTRACT

A firearm locking system includes a magazine plug assembly and a locking bracket. The magazine plug assembly has an outer body configured to fit within a magazine well of a firearm and includes a locking mechanism partially contained within the outer body. The locking mechanism includes a locking bar configured to partially extend into a barrel of the firearm when an actuatable end of the locking bar is pivoted from an unlatched position to a latched position. The locking bar is then held in the latched position by a locking bracket that is secured to the base of the magazine plug assembly by inserting the actuatable end of the locking bar into a cooperatively sized slot within the locking bracket and then inserting a padlock shackle into an opening within the actuatable end of the locking bar.

15 Claims, 15 Drawing Sheets

FIREARM LOCKING SYSTEM

CROSS-REFERENCE TO RELATED APPLICATIONS

The present application is a Continuation-in-Part of U.S. application Ser. No. 18/510,225, filed Nov. 15, 2023, and titled "FIREARM LOCKING SYSTEM," which is incorporated herein by reference in its entirety.

TECHNICAL FIELD

The present disclosure relates to firearms, more specifically to systems for locking and securely storing firearms.

BACKGROUND

Many individuals own firearms for line-of-duty, personal defense, and/or recreational purposes. It is often desirable to display firearms instead of keeping them locked in a gun safe. However, great caution must be taken to prevent malicious actors (e.g., burglars), young children, or inexperienced adults from handling active firearms. Even gun safes only provide a single barrier to access which may not be enough especially for individuals that keep several firearms in one safe.

Some locking systems are configured to secure firearms individually. However, many of the existing systems are easily circumvented. Cable locks are among the most commonly used locking systems. A cable lock typically comprises a cable that can be locked in a loop extended through a magazine well of a firearm to block access to the magazine well. But a hacksaw or strong enough pair of clippers can be used to cut the cables without damaging the firearm. As a result, cable locks are good for preventing young children in one's household from accessing firearms, but they may prove to be ineffective against a malicious actor.

There is a need for firearm locking systems that provide more robust protection than existing systems such as the cable locks described above.

SUMMARY

A firearm locking system (hereinafter "FLS") is disclosed. The FLS includes a magazine plug assembly and a locking bracket configured to be secured to the magazine plug assembly after the magazine plug assembly is plugged into a magazine well of a firearm.

In some embodiments, the magazine plug assembly includes an outer body configured to fit within the magazine well of the firearm, a locking plate partially contained within the outer body, and a locking mechanism that is also partially contained within the outer body. The locking plate has an external portion that extends from a base of the magazine plug assembly (i.e., from the base of the outer body), wherein the external portion of the locking plate includes an opening configured to receive a padlock shackle. The locking mechanism includes a locking bar configured to partially extend into a barrel of the firearm when an actuatable end of the locking bar is advanced into the base of the magazine plug assembly as a result of its contact with the locking bracket as described below.

The locking bracket includes a base panel configured to press upon and thereby advance the actuatable end of the locking bar into the base of the magazine plug assembly when the base panel is secured to the base of the magazine plug assembly. In embodiments, the base panel includes a slot configured to receive the external portion of the locking plate so that the base panel can be secured to the base of the magazine plug assembly by inserting the padlock shackle into the opening in the external portion of the locking plate after the external portion of the locking plate is first inserted into the slot of the base panel. The padlock is then closed to secure and lock the magazine plug assembly and locking bracket together with the locking mechanism suspended in a latched configuration (i.e., with its actuatable end pressed in, so that the locking bar is extended into the barrel of the firearm). At this point, the firearm is locked by the FLS and can only be unlocked by unlocking and removing the padlock to allow removal of the locking bracket and release of the magazine plug assembly from the magazine well of the firearm.

In other embodiments, the magazine plug assembly is configured without the need for a separate locking plate. Instead, the locking mechanism includes a locking bar configured to partially extend into a barrel of the firearm when an actuatable end of the locking bar is pivoted from an unlatched position to a latched position, wherein the actuatable end of the locking bar extends from the base of the magazine plug assembly and includes an opening configured to receive a padlock shackle. To accommodate this alternative design, the locking bracket may include a base panel with a protrusion configured to hold the actuatable end of the locking bar in the latched position when the base panel is secured to the base of the magazine plug assembly, wherein the base panel includes a slot configured to receive the actuatable end of the locking bar so that the base panel can be secured to the base of the magazine plug assembly by inserting the padlock shackle into the opening in the actuatable end of the locking bar after the actuatable end of the locking bar is inserted into the slot of the base panel.

This Summary is provided solely as an introduction to subject matter that is fully described in the Detailed Description and Drawings. The Summary should not be considered to describe essential features nor be used to determine the scope of the Claims. Moreover, it is to be understood that both the foregoing Summary and the following Detailed Description are example and explanatory only and are not necessarily restrictive of the subject matter claimed.

BRIEF DESCRIPTION OF THE DRAWINGS

The Detailed Description is provided with reference to the accompanying Drawings. The use of the same reference numbers in different instances in the Detailed Description and the Drawings may indicate similar or identical items. The Drawings are not necessarily to scale, and any disclosed processes may be performed in an arbitrary order, unless a certain order of steps/operations is inherent or specified in the Detailed Description or in the Claims.

DETAILED DESCRIPTION

A firearm locking system (hereinafter "FLS") is described with reference to FIGS. 1 through 15. The FLS provides a number of advantages over existing gun locks, such as the commonly used cable locks. For example, advantages of the FLS may include but are not limited to: (1) complete plugging of a firearm's magazine well; (2) blocking of the firearm's barrel; (3) compatibility with most padlocks; (4) blocking of the firearm's magazine release button and disassembly pins in preferred embodiments; and (5) integrated means for mounting the firearm to a wall structure.

Figure 1:
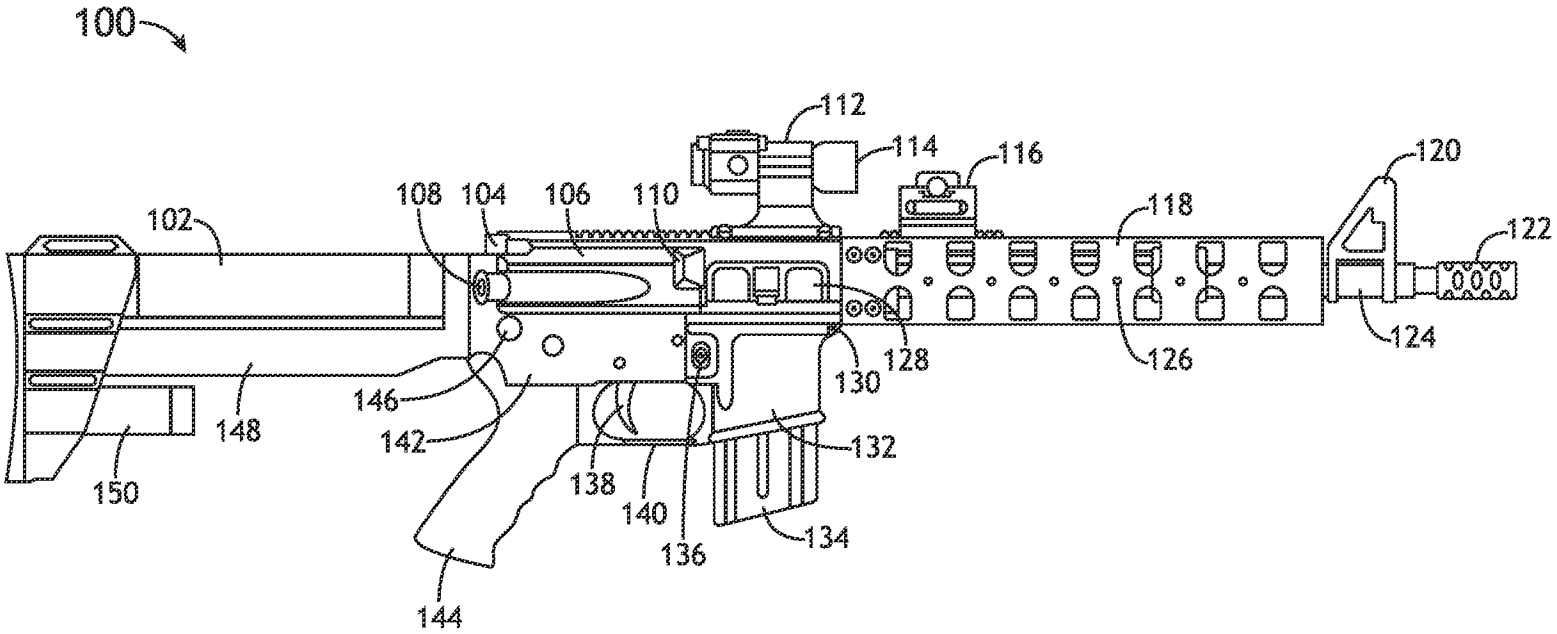
FIG. 1 is a side view of an assault rifle style firearm (e.g., AR-15), in accordance with an example embodiment of the present disclosure.

FIG. 1 illustrates an example embodiment of a firearm 100 that can be locked using the FLS. The firearm 100 in FIG. 1 is an assault rifle style firearm (e.g., an AR-15); however, the FLS can be used to lock any other type of firearm that uses a magazine as its ammunition storage and feeding device. A parts list for the firearm 100 is provided for context; however, the following parts list is not exhaustive nor are all the parts mandatory components of the firearm 100. Parts of the firearm may include but are not limited to: buttstock buffer tube 102; charging cradle 104; upper receiver 106; forward assist 108; shell deflector 110; optic mount 112; optic 114; rear sight 116; handguard 118; front sight 120; muzzle brake 122; barrel 124; accessory rail mounting holes 126; ejection port dust cover 128; front pivot pin 130; magazine well 132; magazine 134; magazine release button 136; trigger 138; trigger guard 140; lower receiver 142; pistol grip 144; rear takedown pin 146; and storage tubes 148 and 150.

Figure 2:
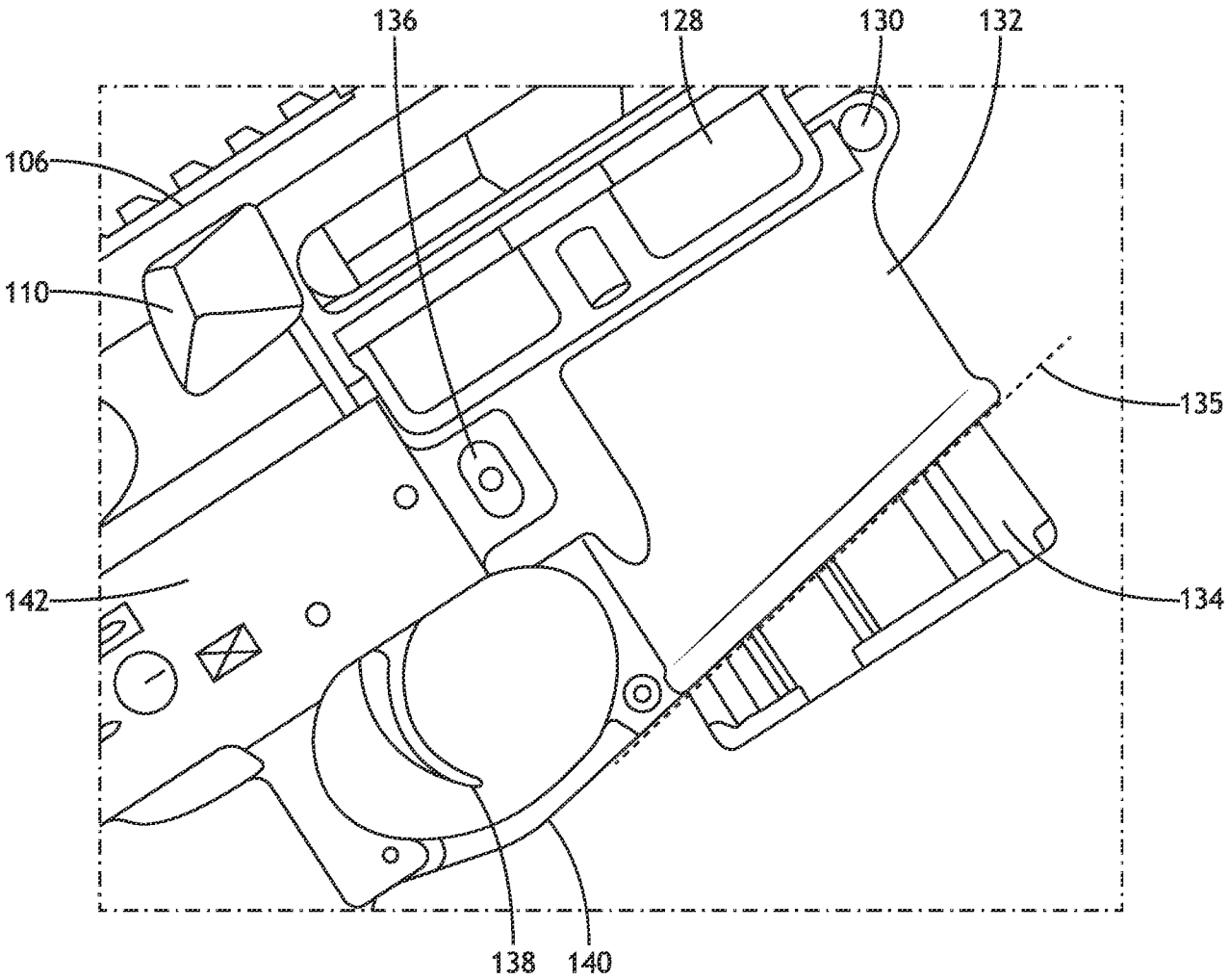
FIG. 2 is a zoomed-in partial perspective view showing detail around a magazine well of the firearm, in accordance with an example embodiment of the present disclosure.

FIG. 2 is a zoomed in view of a portion of firearm 100 including the magazine well 132. The FLS includes a magazine plug assembly 200 (see FIG. 3A) that is configured to mimic the magazine 134 of the firearm 100. For example, the magazine plug assembly 200 fits into the magazine well 132 in place of the magazine 134 and engages the magazine release button 136 such that magazine plug assembly 200 cannot be removed from the magazine well 132 without pressing/toggling the magazine release button 136. In preferred embodiments, the base of the magazine plug assembly 200 is substantially flush (e.g., flush, or indented/outdented no more than 10 mm) with respect to an outer rim of the magazine well 132 when the magazine plug assembly 200 is plugged into the magazine well 132. For example, a dashed line 135 in FIG. 2 indicates where the base of the magazine plug assembly 200 may sit relative to the magazine well 132.

Figure 3B:
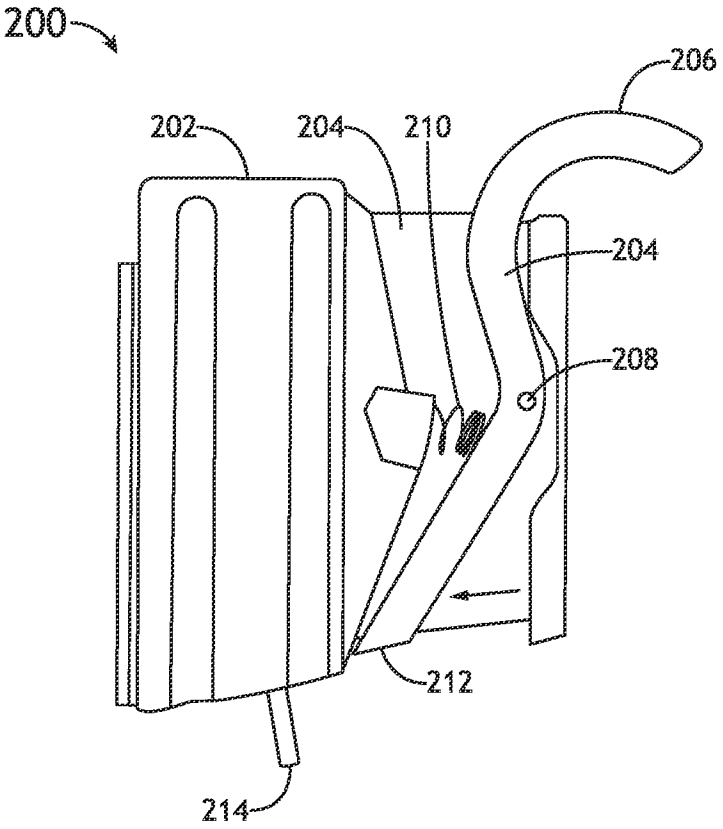
FIG. 3B is another side view of the magazine plug assembly, wherein the locking mechanism is in a latched configuration, in accordance with an example embodiment of the present disclosure.
Figure 3A:
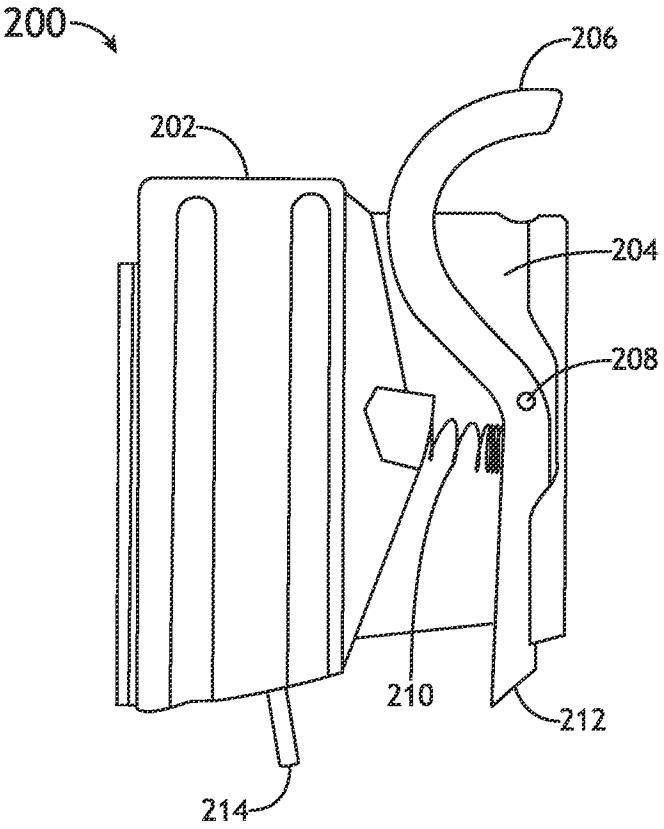
FIG. 3A is a side view of a magazine plug assembly of a firearm locking system that can be used to lock the firearm, wherein the magazine plug assembly includes a locking mechanism, and the locking mechanism is in an unlatched configuration, in accordance with an example embodiment of the present disclosure.

As shown in FIG. 3A, the magazine plug assembly 200 has an outer body 202 configured to fit within the magazine well 132 of the firearm 100. In some embodiments, the outer body 202 of the magazine plug assembly 200 comprises a cutoff portion of a magazine 134 for the firearm 100. For example, the outer body 202 of the magazine plug assembly 200 may be formed by cutting the magazine 134 along the dashed line 135 in FIG. 2. In other embodiments, the outer body 202 of the magazine plug assembly 200 is manufactured into a shape and size that conforms to the magazine well 132 of the firearm 100 (e.g., at least partially mimicking the shape of the magazine 134, i.e., at least the portion above dashed line 135). For example, the outer body 202 of the magazine plug assembly 200 may comprise a 3D printed, injection molded, or metal cast shell with a shape that conforms to the magazine well 132 of the firearm 100. Any other appropriate manufacturing process can also be used without departing from the scope of this disclosure.

Figure 4B:
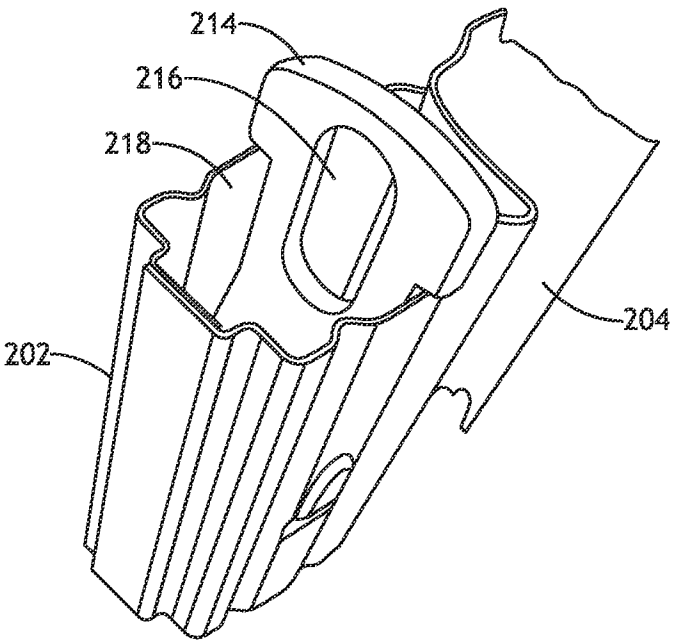
FIG. 4B is a perspective view of the magazine plug assembly, wherein the locking plate is mounted within a cavity defined by an outer body of the magazine plug assembly, in accordance with an example embodiment of the present disclosure.
Figure 4A:
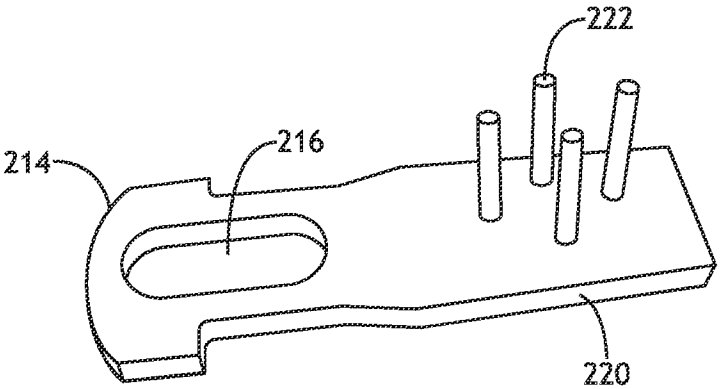
FIG. 4A is a perspective view of a locking plate that is configured to extend from the magazine plug assembly, in accordance with an example embodiment of the present disclosure.
Figure 10C:
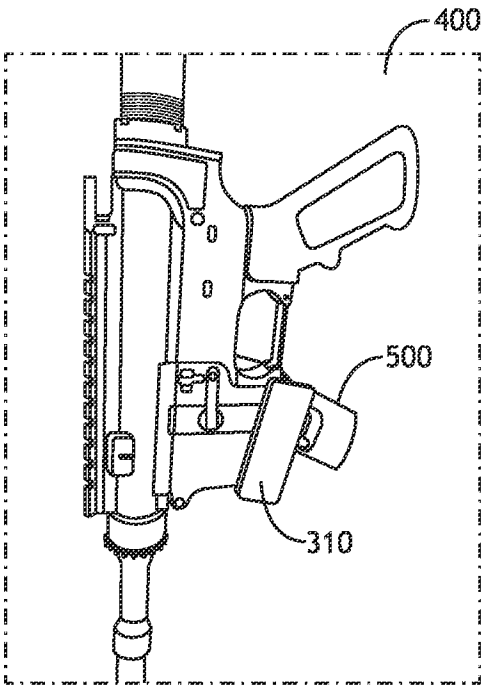
FIG. 10C is a partial side view of the firearm fully engaged with the firearm locking system and mounted to a wall structure after performing steps illustrated in FIGS. 7A through 10C, in accordance with an example embodiment of the present disclosure.
Figure 10B:
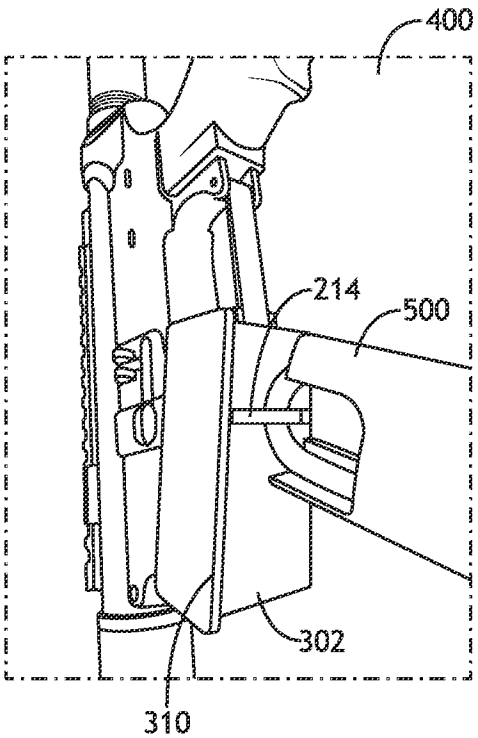
FIG. 10B is a partial perspective view showing the padlock after being secured to the locking plate of the magazine plug assembly, after the locking plate has been inserted within the cooperatively shaped slot of the locking bracket in order to secure the locking bracket to the magazine plug assembly, after the magazine plug assembly has been inserted and secured within the magazine well of the firearm, in accordance with an example embodiment of the present disclosure.
Figure 10A:
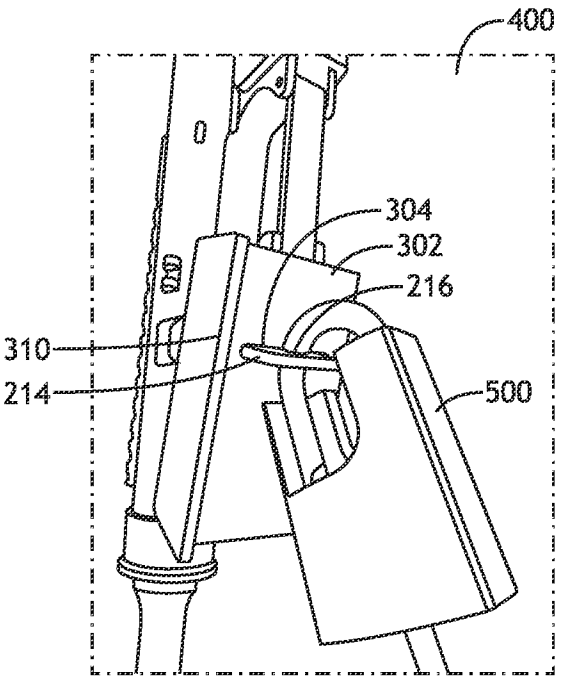
FIG. 10A is a partial perspective view showing a padlock being secured to the locking plate of the magazine plug assembly, after the locking plate has been inserted within the cooperatively shaped slot of the locking bracket in order to secure the locking bracket to the magazine plug assembly, after the magazine plug assembly has been inserted and secured within the magazine well of the firearm, in accordance with an example embodiment of the present disclosure.

The magazine plug assembly 200 includes a locking plate 214 partially contained within the outer body 202. For example, at least a portion of the locking plate 214 extends from a base of the magazine plug assembly 200 (i.e., from the base of the outer body 202). Sometimes this is referred to herein as the "external portion" of the locking plate 214. As shown in FIGS. 4A and 4B, the external portion of the locking plate 214 includes an opening 216. This opening 216 is configured to receive a padlock shackle (e.g., as shown in FIGS. 10A through 10C). Referring again to FIGS. 4A and 4B, the locking plate 214 may further include one or more keepers 222 (e.g., pins or other mounting features) that hold an internal portion 220 of the locking plate 214 within a cavity 218 defined by the outer body 202 of the magazine plug assembly 200. In some embodiments, the outer body 202 includes a separate cavity 204 configured to hold a locking mechanism. Alternatively, the locking plate 214 and locking mechanism may be adjacent to one another within a shared cavity that is defined by the outer body 202 of the magazine plug assembly 200 (e.g., as shown in FIG. 12).

Figure 12:
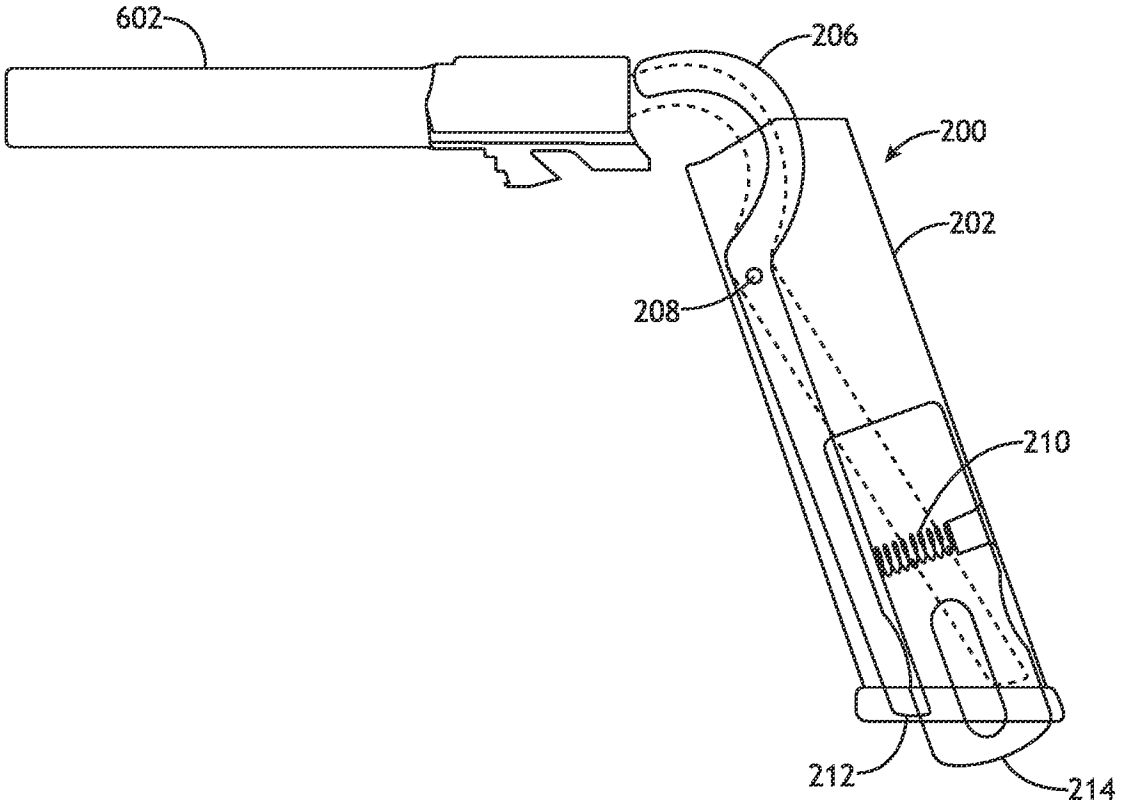
FIG. 12 is a schematic illustration of a magazine plug assembly designed for the handgun style firearm, in accordance with an example embodiment of the present disclosure.

Referring again to FIGS. 3A and 3B, the magazine plug assembly 200 includes a locking mechanism that is also partially contained within the outer body 202 (i.e., within a separate cavity 204 or within a shared cavity as shown in FIG. 12). The locking mechanism includes a locking bar 206 configured to partially extend into the barrel 124 of the firearm 100 when an actuatable end 212 of the locking bar 206 is advanced (e.g., pushed and/or swung) into the base of the magazine plug assembly 200. FIG. 3A shows the locking mechanism in an unlatched configuration where the actuatable end 212 of the locking bar 206 is extended from the base of the magazine plug assembly 200, and FIG. 3B shows the locking mechanism in a latched configuration where the actuatable end 212 of the locking bar 206 is pressed into the base of the magazine plug assembly 200.

In embodiments, the locking mechanism includes a pivot pin 208 that holds an internal portion of the locking bar 206 within the outer body 202 of the magazine plug assembly 200. This allows the actuatable end 212 of the locking bar 206 to be swung into the base of the magazine plug assembly 200 by rotating the locking bar 206 about the pivot pin 208. Pressing upon the actuatable end 212 of the locking bar 206 and thereby advancing the actuatable end 212 of the locking bar 206 into the base of the magazine plug assembly 200 forces the locking bar 206 to rotate about the pivot pin 208. The locking mechanism may further include a biasing spring 210 that retains the locking bar 206 in an unlatched configuration when the actuatable end 212 of the locking bar 206 is not being pressed upon by an external force in order to force a rotation of the locking bar 206 about the pivot pin 208. For example, FIG. 3A shows the biasing spring 210 forcing the locking bar 206 into the unlatched configuration, and FIG. 3B shows what happens when the biasing spring 210 force is overcome by an external force pressing upon the actuatable end 212 of the locking bar 206 to force the locking bar 206 into the latched configuration, whereby the distal end of the locking bar 206 is swung forward.

Figure 5C:
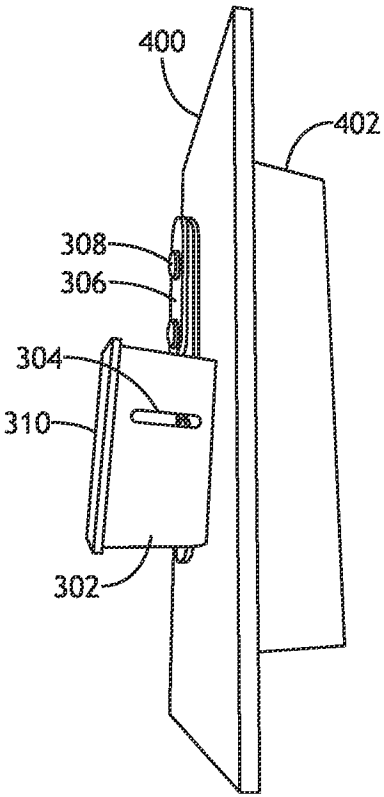
FIG. 5C is another perspective view of the locking bracket, in accordance with an example embodiment of the present disclosure.
Figure 5B:
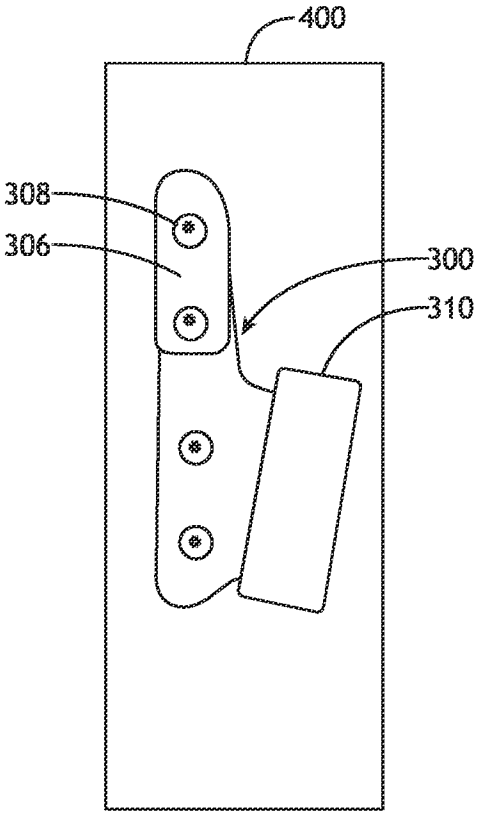
FIG. 5B is a side view of the locking bracket, in accordance with an example embodiment of the present disclosure.
Figure 5A:
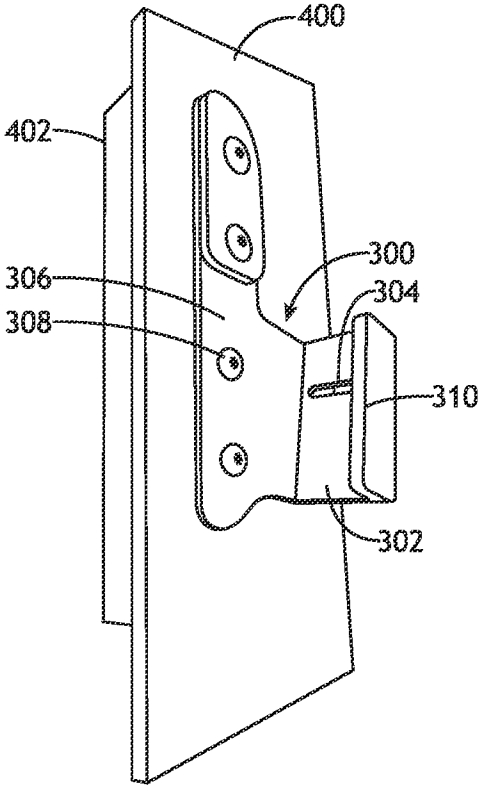
FIG. 5A is a perspective view of a locking bracket of the firearm locking system, wherein the locking bracket is configured to be secured to the magazine plug assembly and is optionally wall-mountable, in accordance with an example embodiment of the present disclosure.
Figure 6:
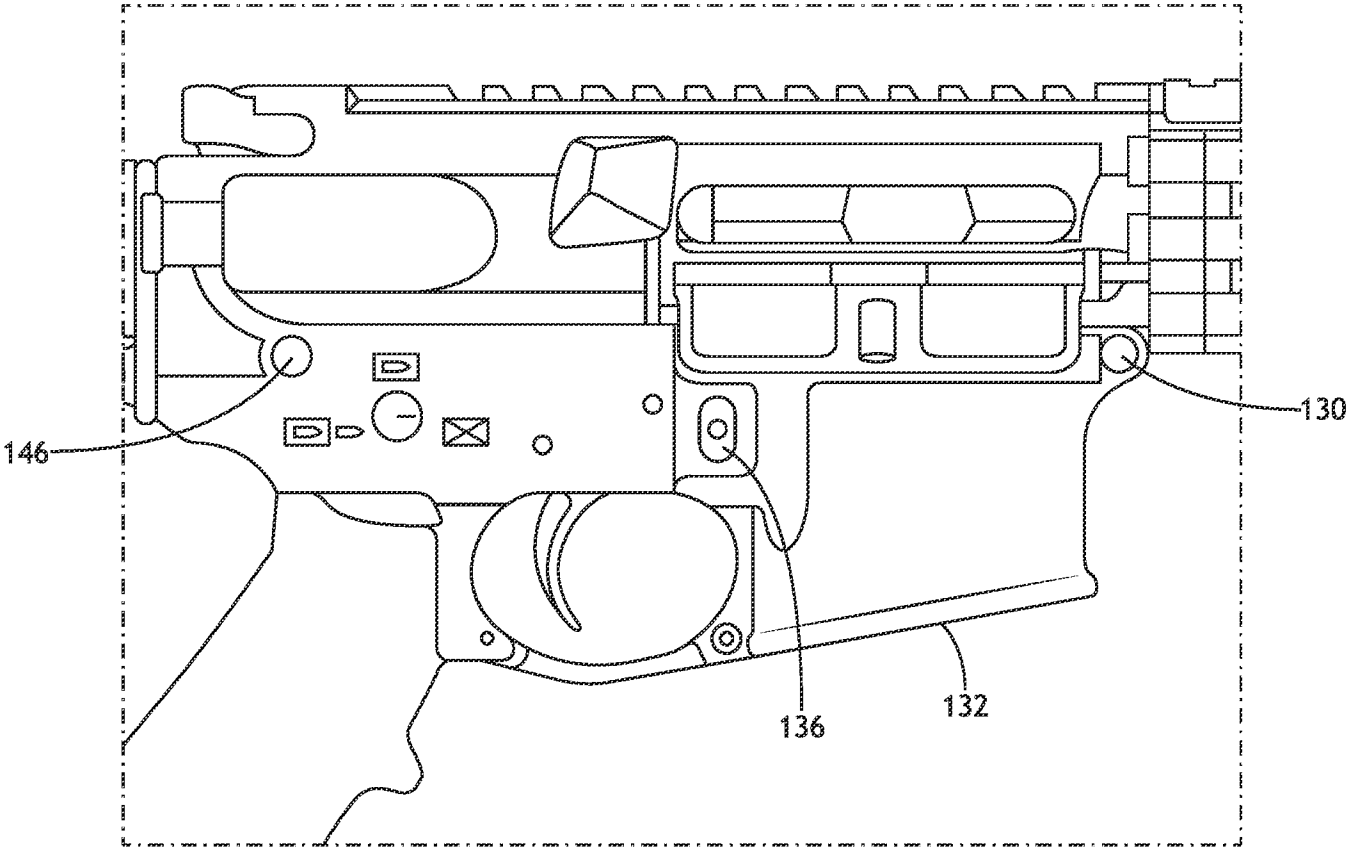
FIG. 6 is a zoomed-in partial side view showing detail between a rear takedown pin and front pivot pin of the firearm, in accordance with an example embodiment of the present disclosure.
Figure 9:
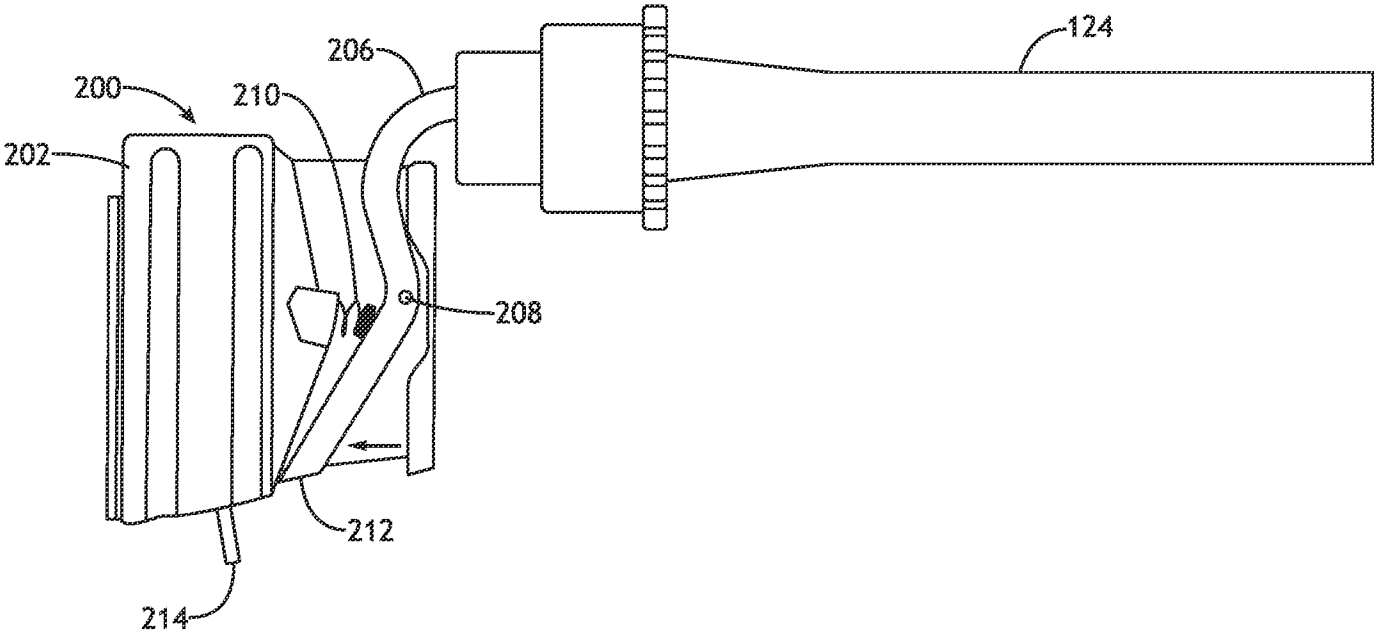
FIG. 9 is a partial internal view showing the magazine plug assembly with a locking bar of its locking mechanism partially extended into the barrel of the firearm as a result of the locking mechanism being placed into the latched configuration when an actuatable end of the locking bar is pressed upon by the locking bracket after performing steps illustrated in FIGS. 7A through 8B, in accordance with an example embodiment of the present disclosure.

As shown in FIG. 3B, the actuatable end 212 of the locking bar 206 may include an angled surface that is configured to be pressed upon by a planar surface (e.g., by the base panel 302 of the locking bracket 300 in FIG. 5A). The locking bar 206 may include a hook-shaped distal end that is opposite the actuatable end 212, wherein the hook-shaped end is configured to be partially extended into the barrel 124 of the firearm 100 when the actuatable end 212 of the locking bar 206 is advanced into the base of the magazine plug assembly 200. For example, FIG. 9 shows how the hook-shaped end of the locking bar 206 is swung forward and partially extended into the barrel 124 of the firearm 100 when the actuatable end 212 is pressed upon by an external force in order to force a rotation of the locking bar 206 about the pivot pin 208 of the locking mechanism (i.e., after the magazine plug assembly 200 has been plugged into the magazine well 132 of the firearm 100). Although specific examples of the actuatable end 212 and distal (opposite) end of the locking bar 206 are discussed herein, it is contemplated that either component may be shaped differently without departing from the scope of this disclosure.

Referring now to FIGS. 5A through 5C, the FLS further includes a locking bracket 300 configured to be secured to the magazine plug assembly 200 after the magazine plug assembly 200 is plugged into the magazine well 132 of the firearm 100. As shown in FIG. 5A, the locking bracket 300 includes a base panel 302 with a slot 304 extending across a portion the base panel 302. The base panel 302 is configured to press upon and thereby advance the actuatable end 212 of the locking bar 206 into the base of the magazine plug assembly 200 when the base panel 302 is secured to the base of the magazine plug assembly 200. The slot 304 is configured to receive the external portion of the locking plate 214 so that the base panel 302 can be secured to the base of the magazine plug assembly 200 by inserting a padlock shackle into the opening 216 in the external portion of the locking plate 214 after the external portion of the locking plate 214 is first inserted into the slot 304 of the base panel 302.

In preferred embodiments, the locking bracket 300 further includes an anti-tampering panel 306 that extends from the base panel 302. For example, the anti-tampering panel 306 may be perpendicular to the base panel 302. In some embodiments, the anti-tampering panel 306 extends from a rear edge of the base panel 302 (see FIG. 5B). The anti-tampering panel 306 may be configured to block a magazine release button 136, rear takedown pin 146, and front pivot pin 130 of the firearm 100 (labeled in FIG. 6) when the base panel 302 is secured to the base of the magazine plug assembly 200. In some embodiments, the anti-tampering panel 306 only protects a subset of these components (e.g., magazine release button 136 only, or magazine release button 136 and either of the rear takedown pin 146 or the front pivot pin 130); however, it is preferred that the anti-tampering panel 306 prevent access to all three components of the firearm 100 when the locking bracket 300 is secured to the magazine plug assembly 200 because blocking access to the magazine release button 136, rear takedown pin 146, and front pivot pin 130 ensures that the firearm 100 cannot be partially disassembled in an attempt to circumvent the FLS. When all three components are blocked, it is impossible (or nearly impossible) to remove the FLS without damaging the firearm 100 and most likely rendering it inoperable.

The anti-tampering panel 306 may also provide a means for mounting the locking bracket 300 to a wall structure 400. For example, the anti-tampering panel 306 may be configured to receive a plurality of fasteners 308 (e.g., screws, bolts, etc.) for mounting the locking bracket 300 to a wall structure 400 (e.g., wood paneling, drywall, etc.) so that the firearm 100 is mounted to the wall structure 400 when the base panel 302 is secured to the base of the magazine plug assembly 200 (i.e., after the magazine plug assembly 200 is first plugged into the magazine well 132 of the firearm 100). In some embodiments, flat head lag screws are used as the fasteners 308 so that the screws cannot be unscrewed from the sides using a wrench. As shown in FIGS. 5A and 5C, in some embodiments, the fasteners 308 may be secured to an internal support frame member 402 (e.g., stud, metal frame, etc.) behind the wall structure 400. As shown in FIG. 5B, the anti-tampering panel 306 may be held flat against the wall structure 400 by the fasteners 308. This adds a layer of protection because the wall structure 400 further prevents access to many components of the firearm 100 after the firearm 100 is secured and mounted by the FLS.

In some embodiments, the locking bracket 300 includes an edge guard 310 that also extends from the base panel 302, opposite the anti-tampering panel 306. The edge guard 310 may also be perpendicular to the base panel 302. In some embodiments, the edge guard 310 extends from a front edge of the base panel 302 (see FIG. 5B). The edge guard 310 is configured to shield the external portion of the locking plate 214 when the base panel 302 is secured to the base of the magazine plug assembly 200. After the firearm 100 is secured and mounted to the wall structure 400 by the FLS, the external portion of the locking plate 214 may be protected on one side by the edge guard 310 and on an opposite side by the wall structure 400 (e.g., as shown in FIGS. 10A through 10C). The edge guard 310 may be formed from thicker or stronger material than the locking plate 214 so that the edge guard 310 can function as a protective barrier to prevent the use of a hack saw to cut off the external portion of the locking plate 214. For example, the edge guard 310 may comprise at least $\frac{1}{8}^{th}$ inch thick hardened steel.

FIGS. 7A through 10C illustrate a process of securing and optionally mounting the firearm 100 using the FLS.

Figure 7B:
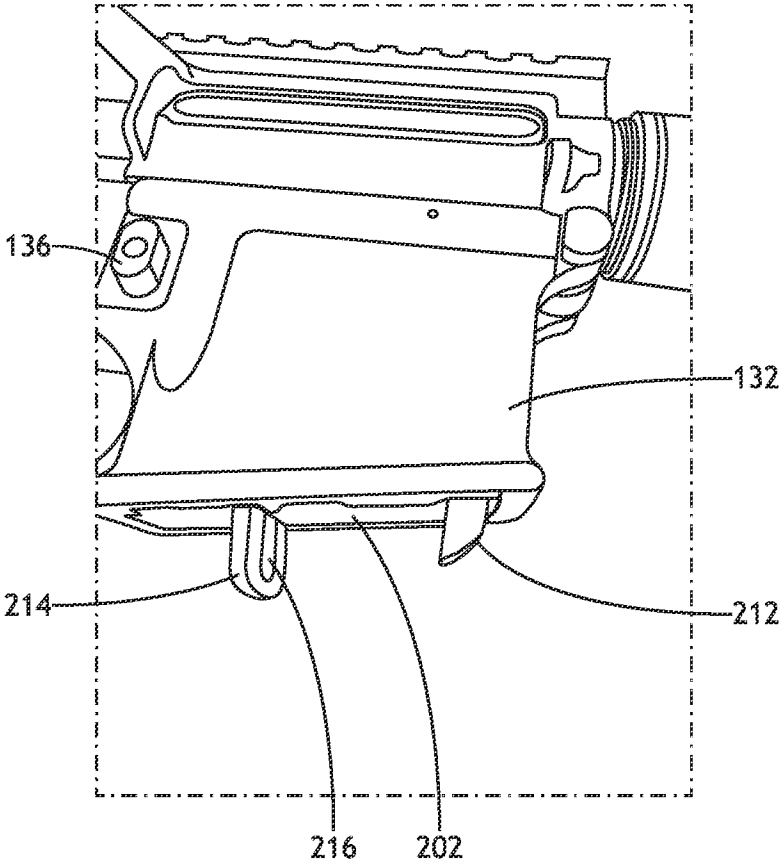
FIG. 7B is a partial perspective view showing the magazine plug assembly after being inserted and secured within the magazine well of the firearm, in accordance with an example embodiment of the present disclosure.
Figure 7A:
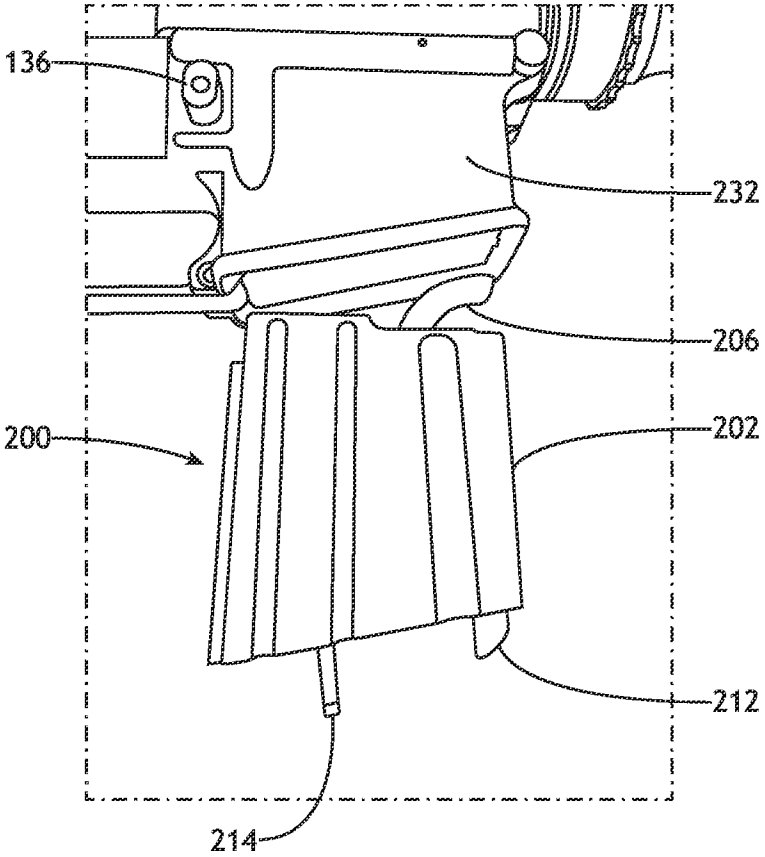
FIG. 7A is a partial perspective view showing the magazine plug assembly being inserted into the magazine well of the firearm, in accordance with an example embodiment of the present disclosure.
Figure 8B:
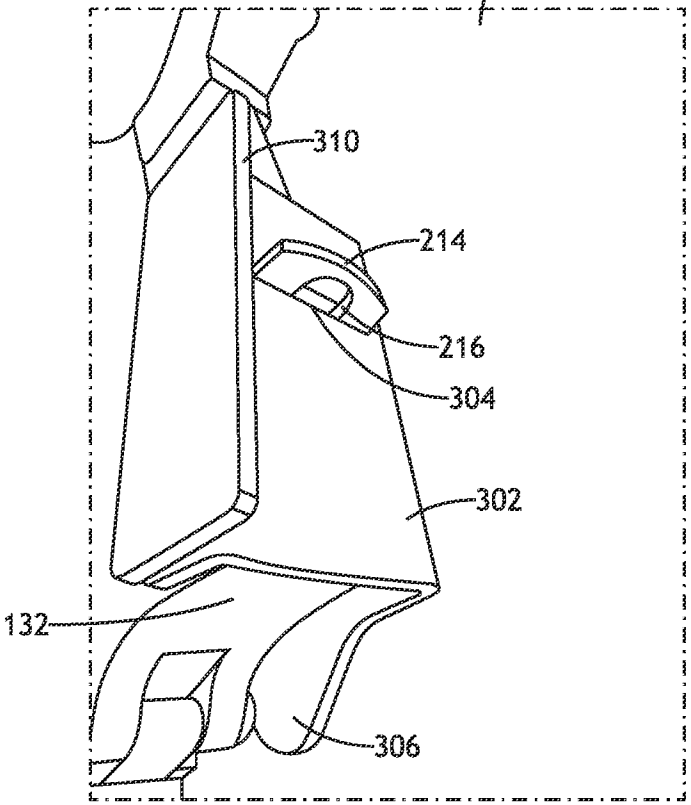
FIG. 8B is a partial perspective view showing the locking plate of the magazine plug assembly after being inserted within the cooperatively shaped slot of the locking bracket in order to secure the locking bracket to the magazine plug assembly, after the magazine plug assembly has been inserted and secured within the magazine well of the firearm, in accordance with an example embodiment of the present disclosure.
Figure 8A:
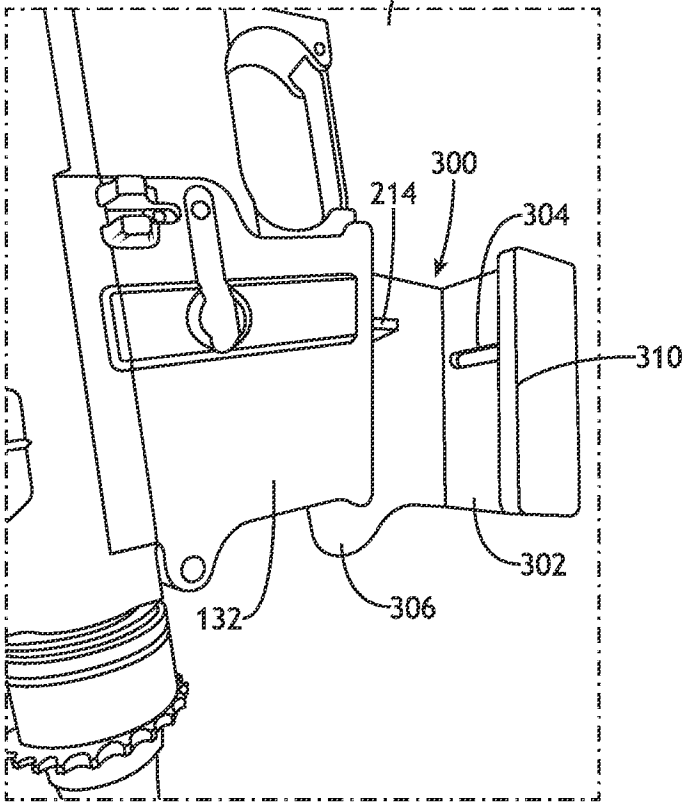
FIG. 8A is a partial perspective view showing a locking plate of the magazine plug assembly being inserted within a cooperatively shaped slot of the locking bracket in order to secure the locking bracket to the magazine plug assembly, after the magazine plug assembly has been inserted and secured within the magazine well of the firearm, in accordance with an example embodiment of the present disclosure.

In FIGS. 7A and 7B, the magazine plug assembly 200 is inserted into the magazine well 132 of the firearm 100. The magazine plug assembly 200 is secured in the magazine well 132 and cannot be removed without pressing the magazine release button 136. At this point, the locking mechanism is still in an unlatched configuration with the actuatable end 212 of the locking bar 206 being extended from the base of the magazine plug assembly 200 (i.e., from the base of the outer body 202). The process continues in FIGS. 8A and 8B, where the locking bracket 300 is secured to the magazine plug assembly 200 by inserting the external portion of the locking plate 214 (including opening 216) into the slot 304 of the base panel 302 of the locking bracket 300 and pushing the magazine plug assembly 200 and the locking bracket 300 together. This causes the base panel 302 to press upon the actuatable end 212 of the locking bar 206 so that it is advanced into the base of the magazine plug assembly 200.

As shown in FIG. 9, the locking bar 206 rotates forward about pivot pin 208 as its actuatable end 212 is advanced (e.g., swung) into the base of the magazine plug assembly 200. As a result, the distal end (e.g., hook-shaped end) of the locking bar 206 extends into the barrel 124 of the firearm 100. Now, the locking mechanism is in the latched configuration.

FIGS. 10A through 10C show additional steps of securing the locking bracket 300 to the magazine plug assembly 200. As shown in FIG. 10A, after the slot 304 in the base panel 302 receives the external portion of the locking plate 204, the base panel 302 can be secured to the base of the magazine plug assembly 200 using a padlock 500 that includes a shackle 502. The padlock shackle 502 is inserted into the opening 216 in the external portion of the locking plate 214 after the external portion of the locking plate 214 is first inserted into the slot 304 of the base panel 302. As shown in FIG. 10B, the padlock 500 is then closed to secure and lock the magazine plug assembly 200 and locking bracket 300 together with the locking mechanism suspended in the latched configuration (i.e., with its actuatable end 212 pressed in, so that the locking bar 206 is extended into the barrel 124 of the firearm 100 as shown in FIG. 9). At this point the firearm 100 is locked by the FLS and can only be unlocked by unlocking and removing the padlock 500 to allow removal of the locking bracket 300 and release of the magazine plug assembly 200 from the magazine well 132 of the firearm 100.

FIG. 10C shows the locked firearm 100 secured and mounted to wall structure 400 by the FLS. It is noted however that mounting the locking bracket 300 (and firearm 100) to a wall structure is optional. The firearm 100 can be locked with the FLS by performing the steps in FIGS. 7A through 10C without mounting or having the locking bracket 300 previously mounted to a wall structure.

Figure 11:
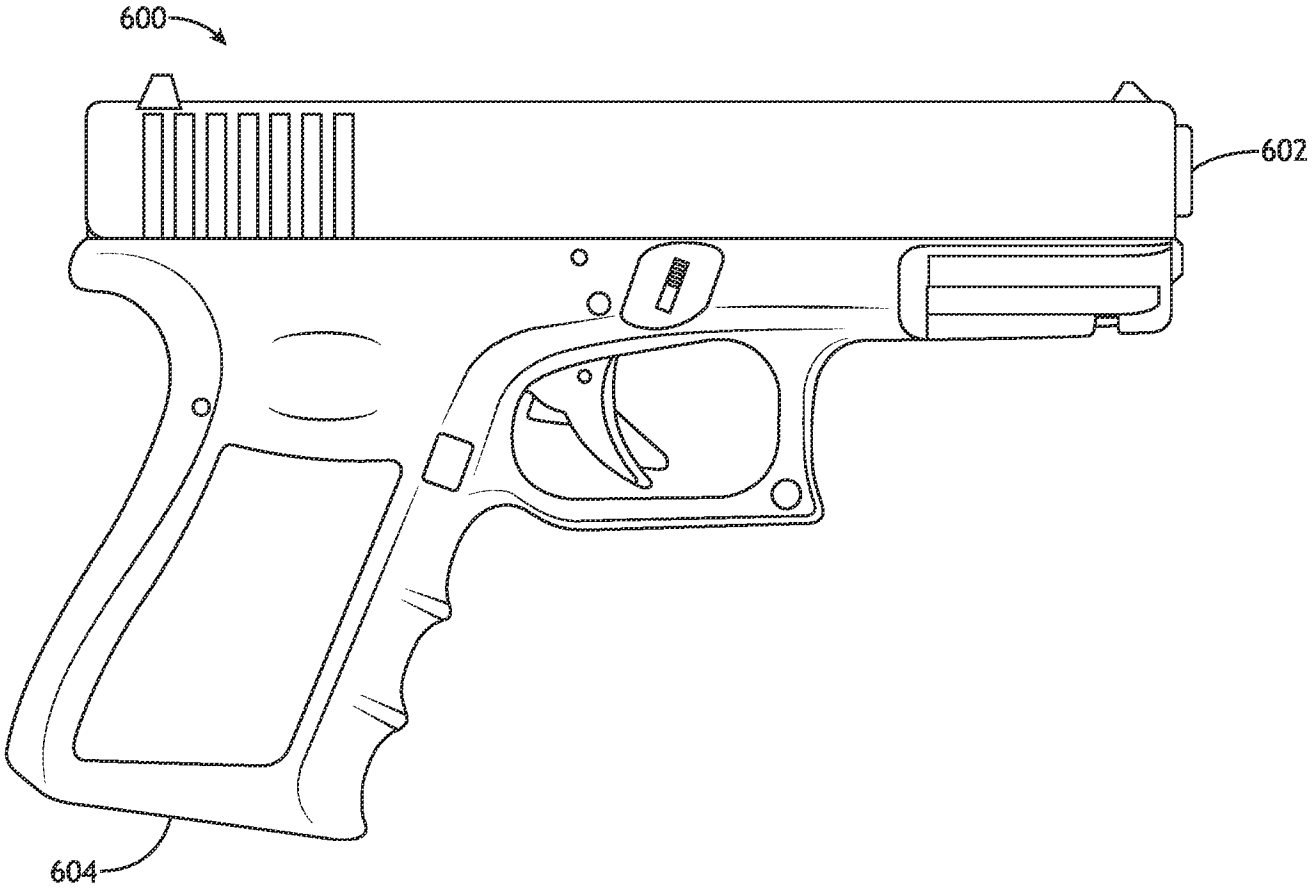
FIG. 11 is a side view of handgun style firearm (e.g., semi-automatic pistol) that can be locked and optionally mounted to a wall structure using the firearm locking system, in accordance with an example embodiment of the present disclosure.

The FLS can also be designed for different types of firearms. For example, FIG. 11 shows an example of handgun style firearm 600 (e.g., a 9 mm pistol) that can be locked in the same manner as the firearm 100 referenced in FIGS. 1 through 10C. FIG. 12 illustrates an embodiment of the magazine plug assembly 200 designed to fit within the magazine well 604 of the firearm 600 so that the locking bar 206 of the magazine plug assembly 200 extends into the barrel 602 of the firearm 600 when the magazine plug assembly 200 is secured to the locking bracket 300.

Figure 13:
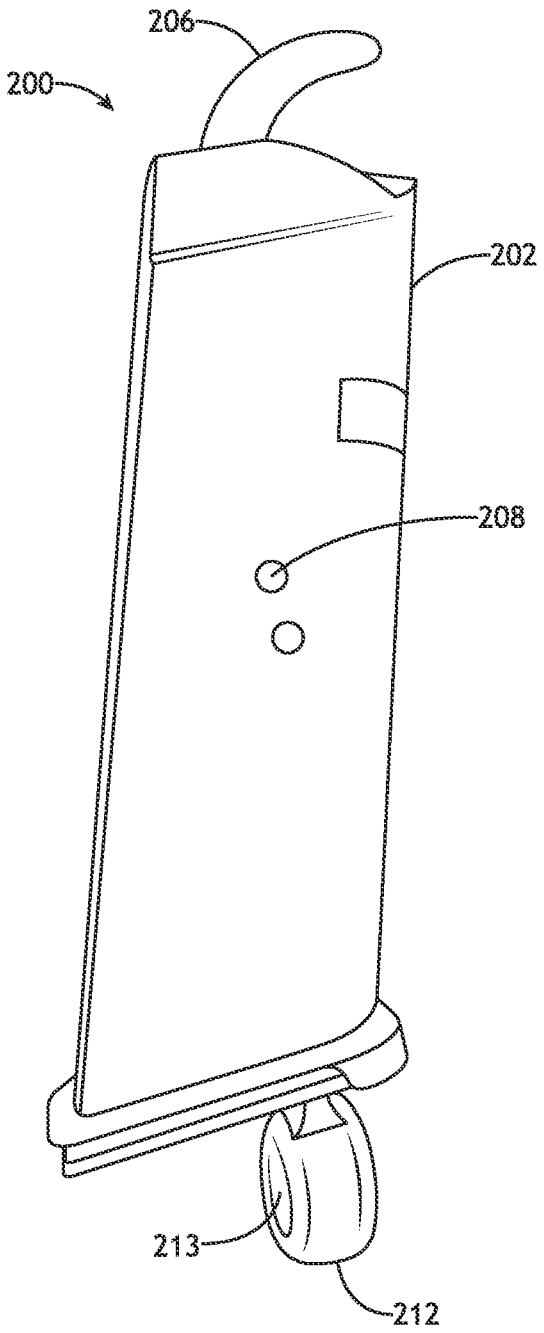
FIG. 13 is a side view of a magazine plug assembly, wherein the magazine plug assembly includes a locking mechanism with integrated locking plate capabilities, and the locking mechanism is in an unlatched configuration, in accordance with an example embodiment of the present disclosure.
Figure 14:
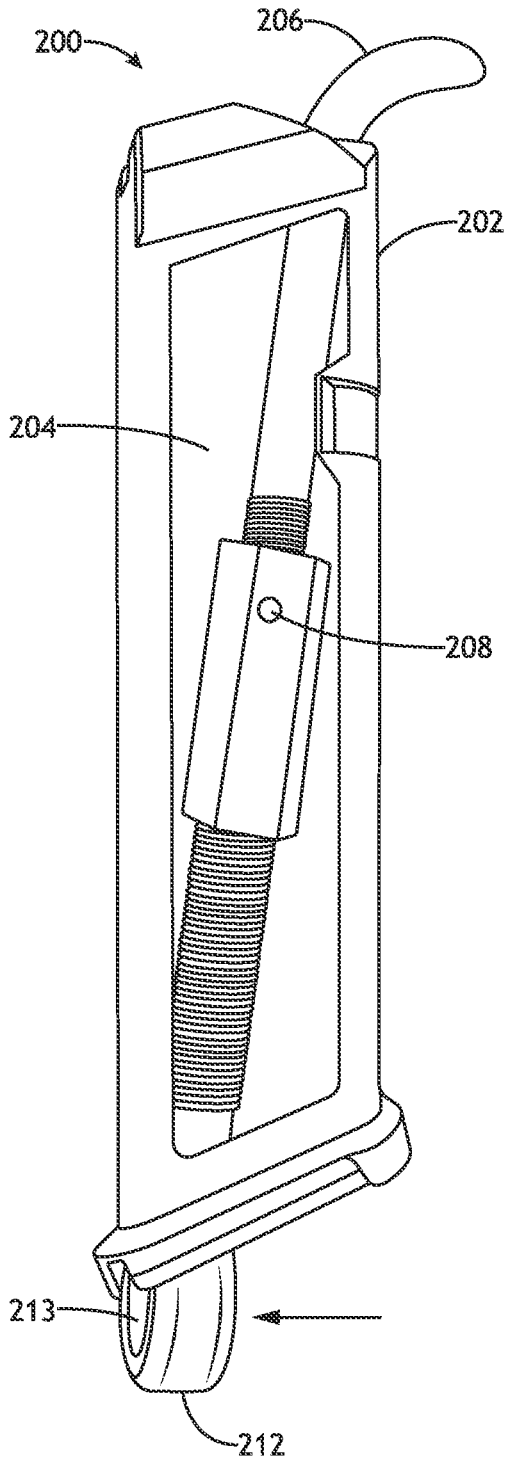
FIG. 14 is a side partially internal view of the magazine plug assembly of FIG. 13, wherein the locking mechanism is in a latched configuration, in accordance with an example embodiment of the present disclosure.
Figure 15:
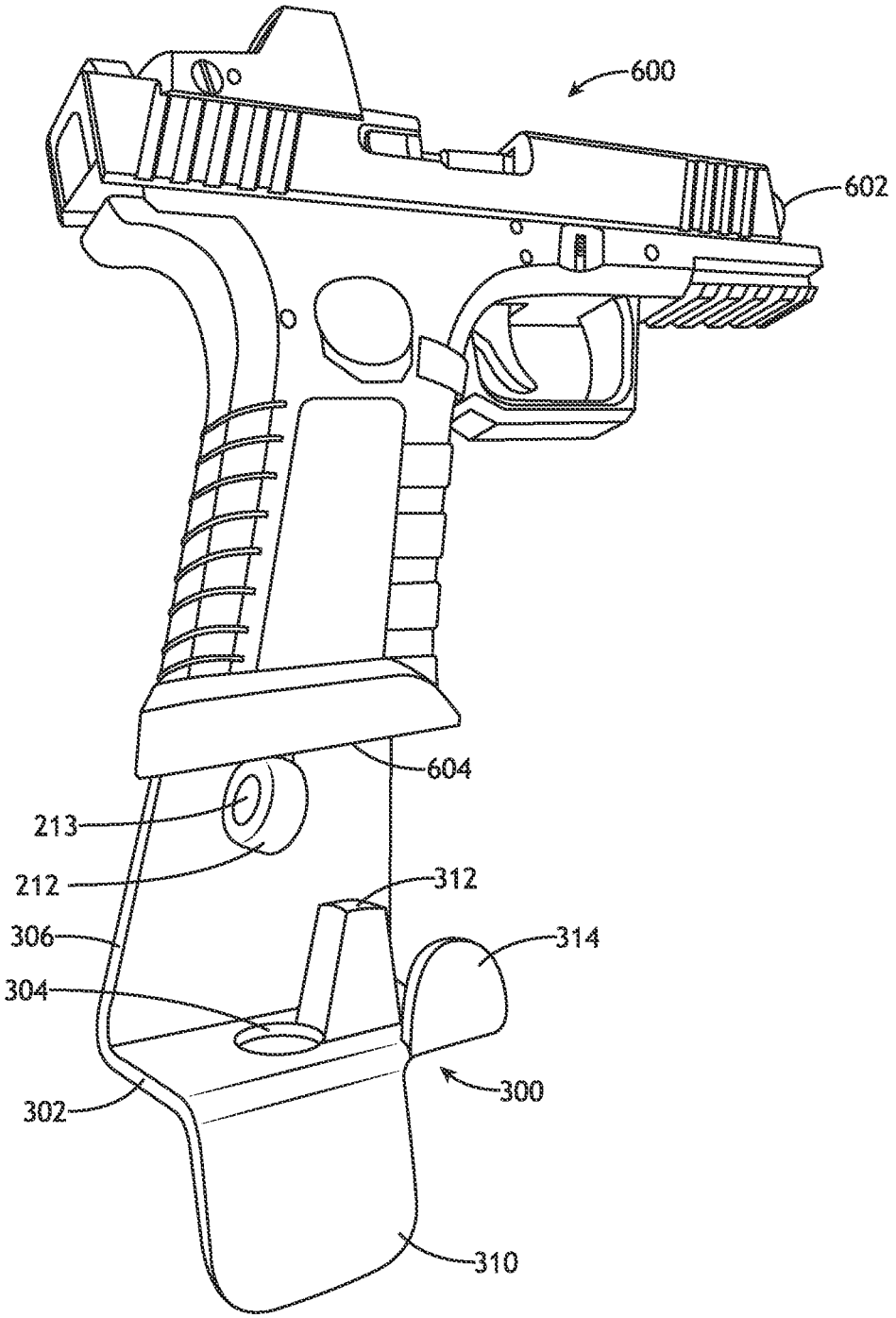
FIG. 15 is a perspective view showing the magazine plug assembly of FIG. 13 after being inserted and secured within the magazine well of a firearm, and further showing an actuatable end of the locking mechanism being inserted within a cooperatively shaped slot of the locking bracket in order to secure the locking bracket to the magazine plug assembly, in accordance with an example embodiment of the present disclosure.

FIGS. 13 through 15 illustrate another embodiment where the magazine plug assembly 200 is configured without the need for a separate locking plate 214. Instead, the magazine plug assembly includes a locking mechanism with integrated locking plate capabilities. As shown in FIGS. 13 and 14, the actuatable end 212 of the locking bar 206 extends from the base of the magazine plug assembly 202 and includes an opening 213 configured to receive a padlock shackle.

Referring now to FIG. 15, the locking bar 206 is configured to partially extend into a barrel 602 of the firearm 600 when an actuatable end 212 of the locking bar is pivoted from an unlatched position to a latched position (i.e., when the actuatable end 212 is swung from its position in FIG. 13 to its position in FIG. 14). To accommodate this alternative design, the locking bracket 300 may include a protrusion 312 (e.g., a fin-like support member) configured to extend from the base panel 302 into the cavity 204 defined by the outer body 202 of the magazine plug assembly 200 to hold the actuatable end 212 of the locking bar 206 in the latched position when the base panel 302 is secured to the base of the magazine plug assembly 200.

The slot 304 within the base panel 302 is configured to receive the actuatable end 212 of the locking bar 206 so that the base panel 302 can be secured to the base of the magazine plug assembly 200 by inserting a padlock shackle into the opening 213 in the actuatable end 212 of the locking bar 206 after the actuatable end 212 of the locking bar 206 is inserted into the slot 304 of the base panel 302.

Additionally, the locking bracket 300 may include a second edge guard 314 opposite the first edge guard 310, where the first edge guard 310 is configured to protect the actuatable end 212 of the locking bar 206 (instead of protecting the locking plate 214) and the second edge guard 314 is configured to protect the protrusion 312 so that neither component can be cut or otherwise destroyed without damaging the firearm 600 and most likely rendering it inoperable.

Aside from the structural differences described above, embodiments of the magazine plug assembly 200 and locking bracket 300 in FIGS. 13 through 15 may include the same or substantially same structural components and configurations as described with regard to embodiments in FIGS. 1 through 12. Furthermore, all embodiments of the magazine plug assembly 200 and locking bracket 300 can be manufactured in appropriate dimensions for any type of magazine bearing firearm (e.g., assault rifle style firearm 100, handgun style firearm 600, or the like).

Although the technology has been described with reference to the embodiments illustrated in the attached drawing figures, equivalents may be employed, and substitutions may be made herein without departing from the scope of the technology as recited in the claims. Components illustrated and described herein are examples of devices and components that may be used to implement the embodiments of the present invention and may be replaced with other devices and components without departing from the scope of the invention. Furthermore, any dimensions, degrees, and/or numerical ranges provided herein are to be understood as non-limiting examples unless otherwise specified in the claims.

What is claimed is:

1. A firearm locking system, comprising:

a magazine plug assembly that includes:

an outer body configured to fit within a magazine well of a firearm; and a locking mechanism partially contained within the outer body, wherein the locking mechanism includes a locking bar configured to partially extend into a barrel of the firearm when an actuatable end of the locking bar is pivoted from an unlatched position to a latched position, wherein the actuatable end of the locking bar extends from the base of the magazine plug assembly and includes an opening configured to receive a padlock shackle; and a locking bracket that includes a base panel with a protrusion configured to hold the actuatable end of the locking bar in the latched position when the base panel is secured to the base of the magazine plug assembly, wherein the base panel includes a slot configured to receive the actuatable end of the locking bar so that the base panel can be secured to the base of the magazine plug assembly by inserting the padlock shackle into the opening in the actuatable end of the locking bar after the actuatable end of the locking bar is inserted into the slot of the base panel.

2. The firearm locking system of claim 1, wherein the outer body of the magazine plug assembly comprises a cutoff portion of a magazine for the firearm.

3. The firearm locking system of claim 1, wherein the outer body of the magazine plug assembly comprises a 3D printed, injection molded, or metal cast shell with a shape that conforms to the magazine well of the firearm.

4. The firearm locking system of claim 1, wherein the base of the magazine plug assembly is substantially flush with an outer rim of the magazine well of the firearm when the magazine plug assembly is plugged into the magazine well of the firearm.

5. The firearm locking system of claim 1, wherein the locking bar includes a hook-shaped end opposite the actuatable end, wherein the hook-shaped end is configured to be partially extended into the barrel of the firearm when the actuatable end of the locking bar is pivoted from the unlatched position to the latched position.

6. The firearm locking system of claim 1, wherein the locking mechanism further includes a pivot pin that holds an internal portion of the locking bar within a cavity defined by the outer body of the magazine plug assembly.

7. The firearm locking system of claim 1, wherein the locking bracket further includes an anti-tampering panel that extends from the base panel and is configured to block a magazine release button, rear takedown pin, and front pivot pin of the firearm when the base panel is secured to the base of the magazine plug assembly.

8. The firearm locking system of claim 7, wherein the anti-tampering panel is further configured to receive a plurality of fasteners for mounting the locking bracket to a wall structure so that the firearm is mounted to the wall structure when the base panel is secured to the base of the magazine plug assembly.

9. The firearm locking system of claim 7, wherein the locking bracket further includes an edge guard that extends from the base panel and is configured to shield the actuatable end of the locking bar when the base panel is secured to the base of the magazine plug assembly, wherein the edge guard is opposite the anti-tampering panel.

10. A magazine plug assembly, comprising:

an outer body configured to fit within a magazine well of a firearm; and a locking mechanism partially contained within the outer body, wherein the locking mechanism includes a locking bar configured to partially extend into a barrel of the firearm when an actuatable end of the locking bar is pivoted from an unlatched position to a latched position, wherein the actuatable end of the locking bar extends from the base of the magazine plug assembly and includes an opening configured to receive a padlock shackle.

11. The magazine plug assembly of claim 10, wherein the outer body comprises a cutoff portion of a magazine for the firearm.

12. The magazine plug assembly of claim 10, wherein the outer body comprises a 3D printed, injection molded, or metal cast shell with a shape that conforms to the magazine well of the firearm.

13. The magazine plug assembly of claim 10, wherein the base of the outer body is substantially flush with an outer rim of the magazine well of the firearm when the magazine plug assembly is plugged into the magazine well of the firearm.

14. The magazine plug assembly of claim 10, wherein the locking bar includes a hook-shaped end opposite the actuatable end, wherein the hook-shaped end is configured to be partially extended into the barrel of the firearm when the actuatable end of the locking bar is pivoted from the unlatched position to the latched position.

15. The magazine plug assembly of claim 10, wherein the locking mechanism further includes a pivot pin that holds an internal portion of the locking bar within a cavity defined by the outer body.

* * * * *